United States Patent [19]

Chern

[11] Patent Number: 5,027,790

[45] Date of Patent: Jul. 2, 1991

[54] OIL-REMOVAL STRUCTURE FOR RANGE HOODS

[76] Inventor: Chern Sheng N., No. 184-5, Pei Hua St., Tainan City, Taiwan

[21] Appl. No.: 497,034

[22] Filed: Mar. 20, 1990

[51] Int. Cl.[5] ..... F24C 15/20

[52] U.S. Cl. ..... 126/299 R; 126/299 D

[58] Field of Search ..... 126/299 R, 299 D, 299 E, 126/300–303, 312, 21 R; 55/DIG. 36; 98/115.1

[56] References Cited

U.S. PATENT DOCUMENTS 3,021,777 2/1962 Smith ..... 126/299 D 3,260,189 7/1966 Jensen ..... 126/299 D 3,596,587 8/1971 Klinger ..... 126/299 D

*Primary Examiner*—James C. Yeung

*Attorney, Agent, or Firm*—Browdy and Neimark

[57] ABSTRACT

An oil-removal structure for range hoods which is characterized by a water container integrally formed with an air-guiding case, into which at least one electrothermal element may be positioned to heat water contained therein so that an oil meltable temperature may be reached. At this point, oily residual on the air-guiding case and exhaust fans of range hoods may be melted and can flow into an oil collector, and the range hoods can be cleaned without the effort required to dismount and disassemble them.

4 Claims, 3 Drawing Sheets

OIL-REMOVAL STRUCTURE FOR RANGE HOODS

BACKGROUND OF THE INVENTION

The general structure of a conventional range hood mainly includes, as shown in FIG. 1 attached hereto, a top housing 11, an inner housing 12, an air-guiding case 13 fixed between the top and the inner housings with two through openings 131 formed at its bottom, two exhaust fans 14 separately connecting two motors and mounted in the through openings 131, and an oil-collector 15 connected to the inner housing 12.

When the exhaust fans 14 are driven and turned by the motors, oily smoke is upwardly exhausted through the fans 14, air-guiding case 13, and duct to the outdoors. Most of the oily smoke condenses to form oily liquid which will flow downwardly and is collected in the oil-collector 15 at, the bottom of the inner housing 12. However, wherever the oily smoke passes will inevitably have residual oily liquid left thereon, such as inside of the air-guiding case 13, the fans of the two exhaust fans 14, the surface of the two motors, the surface of the inner housing 12, etc. It is quite easy to clean the surface of the inner housing 12, however, it is very difficult to clean the air-guiding case 13 and the exhaust fans 14 which are enclosed inside of a range hood. After long use, accumulated oily residual on the exhaust fans 14 or air-guiding case 13 will hinder the operation of the exhaust fans 14 to unnecessarily consume more electricity. Hardened oily residual will also block up the oil drain hole which in turn greatly reduces the oil-collection function of the range hood. Even worse, excessive oily residual on the exhaust fans 14 might drop down to the range under the range hood and cause great trouble to housewives. Usually, it is necessary for the users to find someone experienced to dismount and disassemble the range hood and throughly clean the same. This work is obviously time-consuming, laborsome, and expensive.

It is therefore tried by the applicant to develop an oil-removal structure for range hoods to eliminate prior drawbacks in conventional range hoods.

SUMMARY OF THE INVENTION

The primary object of the invention is to provide an oil-removal structure for range hoods. With this oil-removal structure and a small amount of electricity, accumulated oil residual on the exhaust fans and air-guiding case in a range hood may be easily removed so that the range hood can always be kept clean and in smooth operation.

The present invention is characterized by a water container formed integrally with an air-guiding case receiving two exhaust fans. At least one electrothermal element downwardly passes a top housing and extends into the water container to heat water contained therein. When the water is heated to a temperature which may melt oily residual on the housing and exhaust fans and air-guiding case, melted oily residual will drop down to an oil-collector.

BRIEF DESCRIPTION OF THE DRAWINGS

A specific embodiment of the invention will now be described with reference to the accompanying drawings of which.

DETAILED DESCRIPTION OF THE PREFERRED EMBODIMENT

Figure 1:
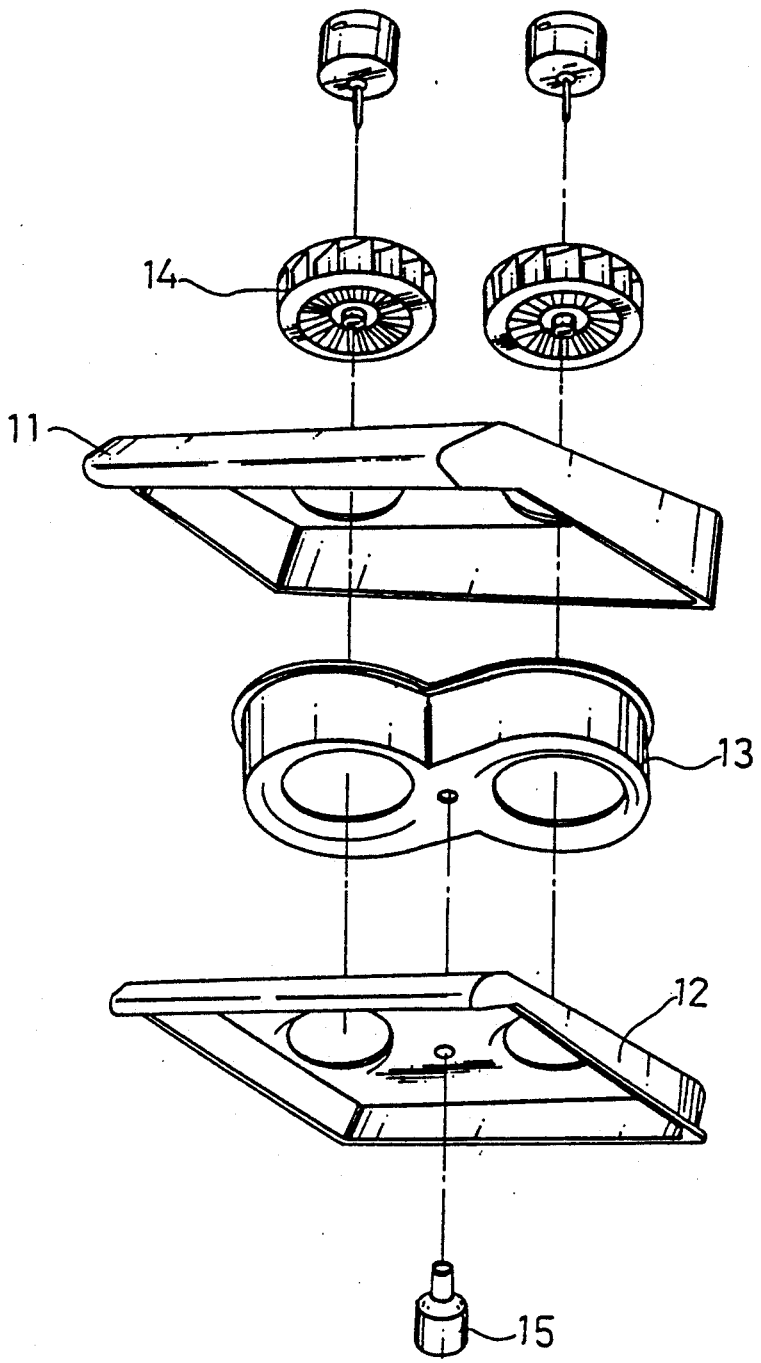
FIG. 1 PRIOR ART
FIG. 1 is a three-dimensional analytical perspective of a conventional range hood.
Figure 2:
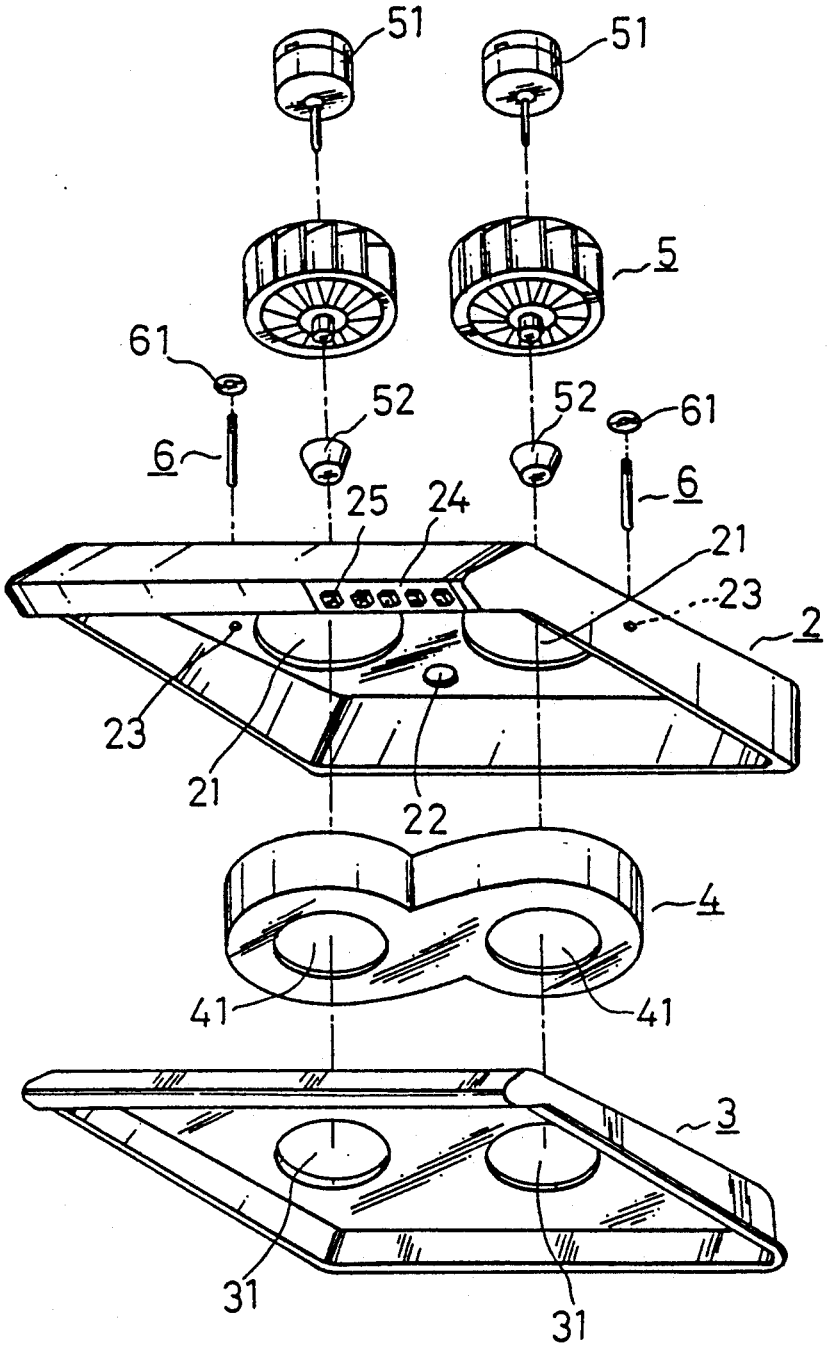
FIG. 2 is a three-dimensional analytical perspective of a preferred embodiment of the invention.

Please refer to FIG. 2. The present invention includes a top housing 2, an inner housing 3, an air-guiding case 4, two exhaust fans 5, and two electrothermal tubes 6.

The top housing 2 has two round openings 21 formed at its top surface. A water inlet 22 and two mounting holes 23 are separately formed at adequate positions around the round openings 21. A switch panel 24 is provided at the front of the top housing 2. Behind the switch panel 24, a circuit composed of a temperature controller or a time controller and a micro-switch are provided for presetting a temperature range and time period. A temperature-control (or time control push-button 25 is further provided on the switch panel 24 for easy control of the temperature or of the time for heating water contained in a water container 42.

The inner housing 3 is fixedly connected to the top housing 2 and has two round openings 31 aligned with the two round openings 21 on the top housing 2.

Figure 3:
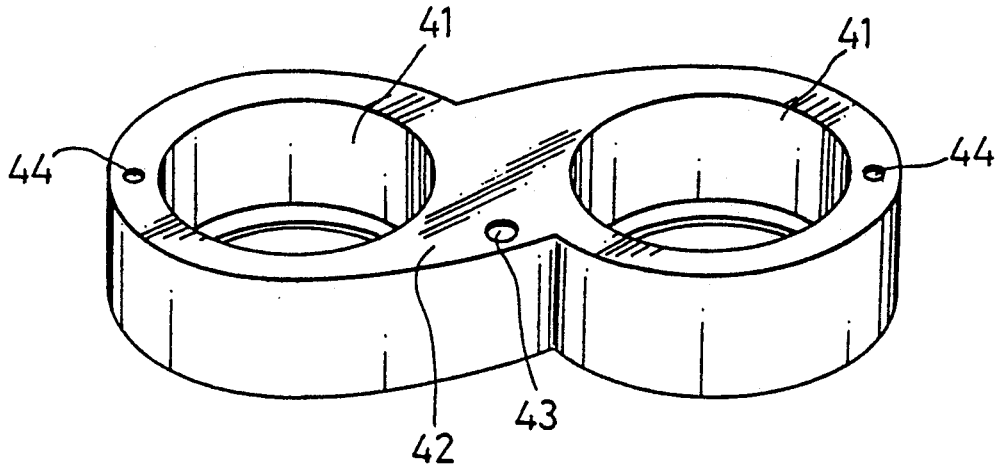
FIG. 3 is a three-dimensional analytical perspective of an air-guiding case of a preferred embodiment of the invention.

The air-guiding case 4 is generally figure-eight shaped, and can be made of stainlesss metals or alloys. It is fixedly connected with and between the top housing 2 and the inner housing 3 and has two hollow round compartments 41 formed at two ends of its figure-eight body for receiving two exhaust fans 5 (please see FIG. 3). A closed space surrounding the two hollow round compartments 41 forms the water container 42. On the top surface of the water container 42, a water inlet 43 and two through holes 44 are formed to align with the water inlet 22 and two mounting holes 23.

The two exhaust fans 5 are mounted between the top housing 2 and the inner housing 3, and are fixedly received in the two round compartments 41 of the air-guiding case 4 separately. Exhaust fans 5 are connected to and are driven by to motors 51. An oil collector 52 is provided at the bottom center of each exhaust fan 5.

Figure 4:
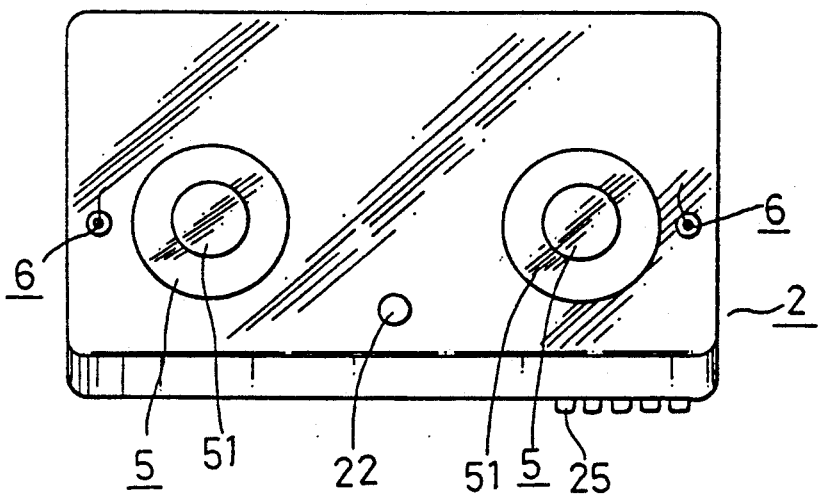
FIG. 4 is a top view of a preferred embodiment of the invention showing an asssembled range hood of the present invention.

The two electrothermal tubes 6 are screwed to the top housing 2 through the two mounting holes 23 with their bottom ends downwardly extending through the through holes 44 on the air-guiding case 4 and into the water container 42. To prevent the contact surface of the stainless metal or alloy made air-guiding case 4 and the two electrothermal tubes 6 from cracking due to thermal expansion, an insulation bushing may be used to coat the two electrothermal tubes 6. In addition, to prevent water in the water container 42 from overflowing out of the mounting holes 23 on the top housing 2, watertight washers 61 may be provided under the mounting holes 23. The watertight washers 61 can be secured to said top housing 2. Moreover, an indicator, such as a bulb, may be provided on the top housing 2 to remind users when the water in the water container 42 is reduced to a lower level due to evaporation. For a beautiful appearance of the entire range hood, wire connecting th electrothermal tubes 6 may run through the top of the top housing 2 and connect the temperature-control pushbutton 25 (as shown in FIG. 4).

When assembling the present invention, first fix the air-guiding case 4 with the exhaust fans 5 received therein between the top housing 2 and the inner housing 3, then separately screw the two electrothermal tubes 6 into the two mounting holes 23 on the top housing 2 with a watertight washer 61 placed thereunder. By this way the bottom ends of the electrothermal tubes 6 will pass through the through holes 44 on the air-guiding case 4 and extend into the water container 42.

To clean and remove oil residual on the exhaust fans 5 and air-guiding case 4 of the range hood, simply pour some water into the water container 42 through the water inlet 22 on the top housing 2 and press the temperature-control pushbutton 25. At this point, the electrothermal tubes 6 will heat water in the air-guiding case 4 to a temperature or for a time set by the temperature-control pushbutton 25. When the temperature or time set by the pushbutton 25 is reached, the heating will automatically stop. The temperature normally set by the temperature controller is slightly higher than that for melting oil (about 40° C. to 80° C.), thus, oily residual on the exhaust fans 5 and air-guiding case 4 may be melted and flow into the oil collector 52.

With the present invention, only a small amount of electricity is required to heat water in the air-guiding case 4 before the oily residual in the range hood can be easily and thoroughly removed without the effort of dismounting and disassembling the whole range hood.

Although the use of an electrothermal element for heating water is a known technique, the structure disclosed in the present invention by the applicant is still new and creative, practical and improved.

We claim:

1. An oil-removal structure for range hoods which is capable of removing oily residual on range hoods by melting said oily residual and permitting the same to drop and flow into an oil collector, comprising:

a top housing and an inner housing;

an air-guiding case mounted between said top housing and said inner housing;

exhaust fans received in said air-guiding case and connecting motors for driving said exhaust fans;

a water container integrally formed with said air-guiding case; and at least one electrothermal element having a bottom end fixedly mounted to extend through said top housing and to extend into said water container wherein its bottom end is immersed into water contained within said water container; said electrothermal element being capable of heating said water in said water container to a temperature at least high enough to melt oil.

2. The oil-removal structure for range hoods of claim 1 wherein a first water inlet is provided on said top housing, and a second water inlet is provided at a position on said air-guiding case aligned with said first water inlet, so that water may be timely added whenever the water in said water container drops below a desired level due to evaporation.

3. The oil-removal structure for range hoods of claim 1 wherein a watertight washer is provided under a mounting hole through which said electrothermal element extends and wherein said watertight washer is secured to said top housing for preventing the water in said water container from overflowing out of said mounting hole.

4. The oil-removal structure for range hoods of claim 1 wherein said water container is integrally formed within said air-guiding case.

* * * * *